United States Patent [19]

Weisz

[11] 4,276,841

[45] Jul. 7, 1981

[54] STITCH LENGTH AND FEED REVERSING CONTROL FOR A SEWING MACHINE

[75] Inventor: William Weisz, Tenafly, N.J.

[73] Assignee: The Singer Company, Stamford, Conn.

[21] Appl. No.: 78,335

[22] Filed: Sep. 24, 1979

[51] Int. Cl.[3] ..... D05D 27/00

[52] U.S. Cl. ..... 112/317

[58] Field of Search ..... 112/313, 314, 315, 316, 112/317

[56] References Cited

U.S. PATENT DOCUMENTS

| | | | |
|---|---|---|---|
| 3,011,462 | 12/1961 | Ritter et al. | 12/315 |
| 3,157,141 | 11/1964 | Goebel | 112/316 |
| 3,949,691 | 4/1976 | Adams | 112/316 |
| 4,145,983 | 3/1979 | Law et al. | 112/317 |

FOREIGN PATENT DOCUMENTS

| | | |
|---|---|---|
| 35-513299 | 5/1960 | Japan . |
| 36-542718 | 7/1961 | Japan . |
| 38-569573 | 5/1963 | Japan . |
| 38-310462 | 7/1963 | Japan . |
| 40-570021 | 6/1965 | Japan . |

*Primary Examiner*—Ronald Feldbaum

*Attorney, Agent, or Firm*—William V. Ebs; Robert E. Smith; Edward L. Bell

[57] ABSTRACT

A stitch length and reversing control for a sewing machine is uniquely arranged to facilitate the selection by a machine operator of the length of stitches to be formed in a work piece, to enable the operator at a convenient location on the machine to quickly reverse the direction in which work is fed from a forward feeding direction to a reverse feeding direction, and to enable the operator to sustain the operation of the machine in a reverse feed mode with hands off the control.

8 Claims, 5 Drawing Figures

STITCH LENGTH AND FEED REVERSING CONTROL FOR A SEWING MACHINE

DESCRIPTION

BACKGROUND OF THE INVENTION

1. Field of the Invention:

The invention relates to stitch length and feed reversing controls for sewing machines.

2. Description of the Prior Art:

It is well known to provide a sewing machine with mechanism for regulating the operation of a feed dog which moves material under a sewing needle, and to provide a control which a machine operator can utilize to position the feed regulating mechanism and thereby select the length of stitches to be formed in a work piece or to quickly change the direction in which fabric is fed under the sewing needle from a forward feeding direction to a reverse feeding direction. However, the feed regulating controls provided heretofore have generally been deficient either in the ability to control the feed regulating mechanism as might be desired, or in being complex in construction and therefor costly to produce.

It is a prime object of this invention to provide a stitch length and feed reversing control which can be used to control feed regulating mechanism and thereby the operation of a feed dog in any of the ways that an operator might wish, which is simple in construction yet durable, and is arranged according to its functions for the convenience of a machine operator.

SUMMARY OF THE INVENTION

In accordance with the invention, a stitch length regulating and feed reversing control is provided with a rotatable and axially movable control shaft and is further provided with a worm gear which is affixed to the shaft and is engaged by a gear segment on a pivotally mounted member. The shaft is positionable by a manually operable control which is movable in one direction for imparting axial movement to the shaft effective to cause the worm gear to move the gear segment and member, and which is movable in another direction for imparting rotational movement to the shaft effective to cause the worm gear to move the gear segment and pivotally mounted member. Linkage means operably connected to the pivotally mounted member and positionable thereby is provided to control the operation of feed regulating mechanism. Such linkage means is positionable in response to rotational movement of the shaft for controlling the length of stitches to be produced in a work piece, and is responsive to axial movement of the shaft for changing the direction in which work is fed under a sewing needle from a forward feeding direction to a reverse feeding direction. Locking means engageable by rotation of the control shaft when in a predetermined reverse feed controlling position are provided for holding the shaft against axial movement to thereby sustain a reverse feeding operation. A feed reversing lever is located apart from the manually operable control and is effectively connected to the pivotally mounted member to enable an operator to quickly and easily position the linkage means in a reverse feed controlling position.

DESCRIPTION OF THE PREFERRED EMBODIMENT

Figure 1:
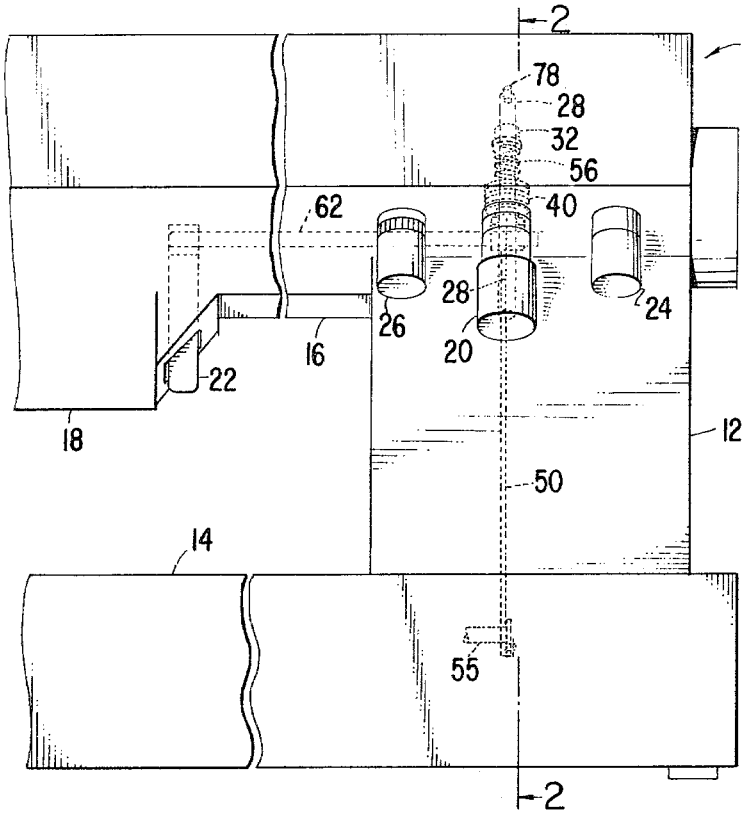
FIG. 1 is a front elevational view of a portion of a sewing machine including the stitch length and feed reversing control of the invention.

Referring to the drawings, reference character 10 designates a sewing machine including a standard 12, a bed 14, and a bracket arm 16 which overhangs the bed and supports the head end 18 of the machine. The machine includes a manually operable control knob 20 and a manually operable feed reversing lever 22 which are part of the control means of the invention. As shown, control knob 20 is located at the standard end of the machine among other control knobs, namely a needle bight control knob 24 and a pattern selecting control knob 26, whereas the feed reversing lever is located adjacent the head end 18 of the machine.

Knob 20 is force fitted on a control shaft 28 which is mounted within the machine for rotational and axial movement in bushings 30 and 32 that are fixedly located in bosses 34 and 36 respectively formed on the casing 38 of machine 10. The shaft carries a suitably affixed worm gear 40 and the worm gear is engaged by a gear segment 42 formed on a member 44 that is pivotally mounted in the machine on a stationary shaft 46. Member 44 pivotally connects with one end 48 of a link 50 that pivotally connects at its other end 52 with a link 54. Link 54 is mounted between the ends thereof at 55 as shown for pivotal movement in the machine.

Worm gear 40 and shaft 28 are biased downwardly by a coil spring 56 extending about the shaft between bushing 32 and the worm gear; and a hub 58 on the worm gear 40 is normally maintained in enforced engagement by the action of the spring with a forked member 60 which embraces the shaft 28 between the worm gear hub 58 and boss 34. The forked member 60 is secured by a set screw 61 to a pivotable shaft 62 that extends to a location adjacent the head 18 of the machine where the quick reversing lever 22 is secured to the shaft by a set screw 64. Knob 20 and a cylindrical post 66 mutually engage in grooves 68 in the post and internal lands 70 in the knob to permit the button to slide on the post. The post includes a slot 72, and a pin 74 which is affixed in the shaft 28 and extends into the slot as shown.

Knob 20 may be turned to impart rotational movement to the post and cause the post acting upon pin 74 in shaft 28 to turn the shaft. Rotational movement of the shaft causes the worm gear 40 to drive gear segment 42 and the member 44 to pivot on shaft 46. Link 50 is moved by member 44 and link 54 is positioned by link 50. Link 54 is selectively positionable by the turning of knob 20 within a forward and reverse feed range wherein it may control the length of stitches to be formed in a forward and reverse feeding direction respectively in a sewing machine. For such purpose, the link 54 may, for example be connected to the feed control rock shaft of feed regulating mechanism such as shown in U.S. Pat. No. 3,527,183 Jan Szostak issued Sept. 8, 1970 and assigned to The Singer Company.

Figure 5:
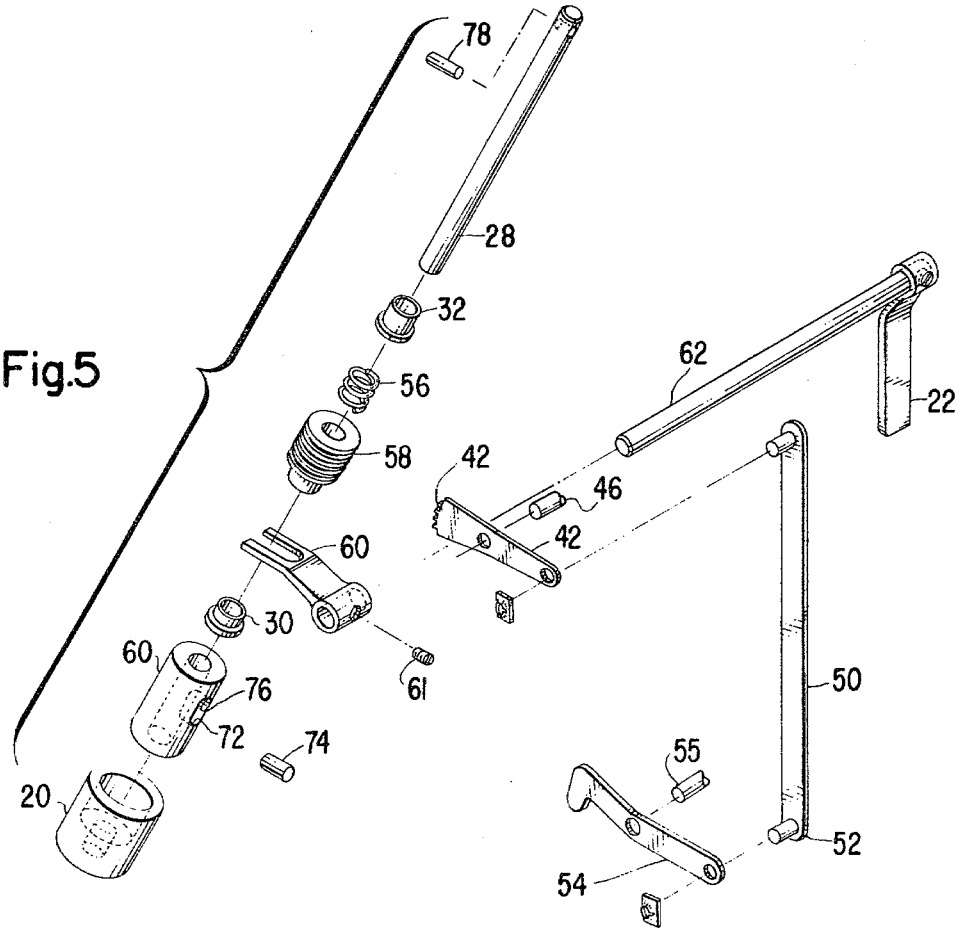
FIG. 5 is an exploded perspective view of the control mechanism.
Figure 4:
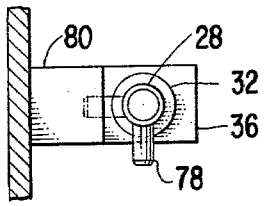
FIG. 4 is a top end view of locking means provided for said control.
Figure 3:
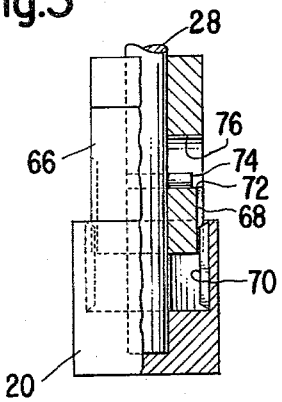
FIG. 3 is a longitudinal plan view partially in section showing a portion of the control.

If it is desired to reverse feed for a protracted period of time, knob 20 is pushed to move shaft 28 axially until pin 74 engages the end 76 of slot 72 in post 66. Worm gear 40 acting on gear segment 42 pivots member 44, the member 44 positions link 50, and the link 50 moves link 54 to the maximum stitch length end of the reverse feed range. The knob is then turned to move a pin 78 located in an end portion of the shaft from the solid line position of FIGS. 4 and 5 to the dotted line position therein above a shoulder 80 on boss 36 after which the knob is released to lock link 54 in position and so sustain a reverse feed operation.

Figure 2:
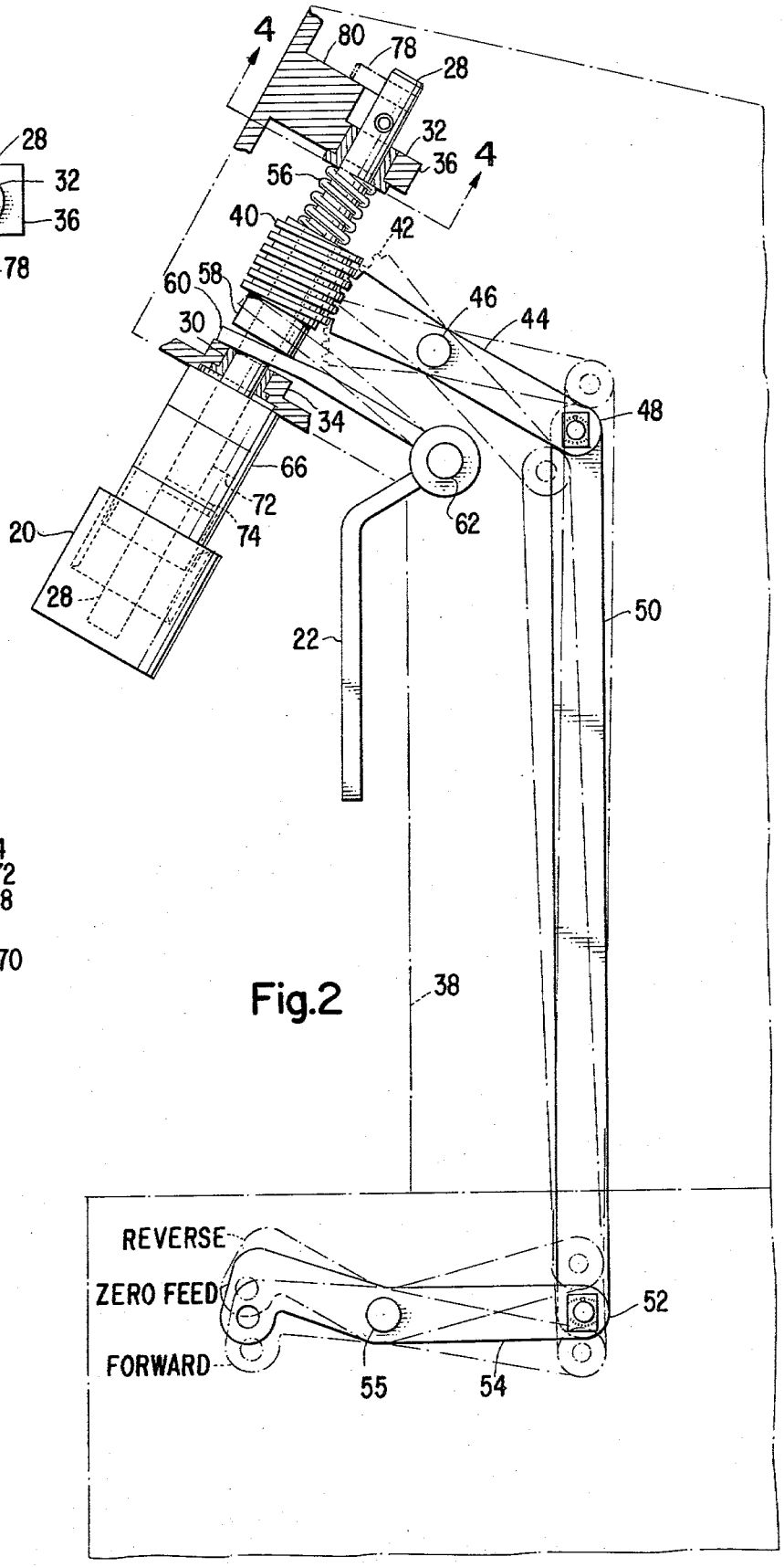
FIG. 2 is a view taken substantially on the plane of the line 2—2 of FIG. 1 and showing the mechanism of the control of the invention.

A quick and temporary reversal in the feeding direction from forward to reverse feed is achieved by lifting the quick feed reversing lever 22, that is moving it in a clockwise direction, as viewed in FIG. 2, on shaft 62. Forked member 60 is thereby caused to raise worm gear 40 and the shaft 28, and the worm gear acting on gear segment 42 pivots member 44. Member 44 moves link 50 and the link 50 moves link 54 into the feed reversing range. Spring 56 causes the link 54 to be returned to the forward feed range when the quick feed reversing lever 22 is released.

It is to be understood that the present disclosure relates to a preferred embodiment of the invention which is for purposes of illustration only and is not to be construed as a limitation of the invention. Numerous modifications and alterations of the structure herein disclosed will suggest themselves to those skilled in the art, and all such modifications and alterations which do not depart from the spirit and scope of the invention are intended to be included within the scope of the appended claims.

I claim:

1. In a sewing machine, stitch length regulating and feed reversing control means including a rotatably and axially movable shaft having a worm gear affixed thereon; a pivotally mounted member having a gear segment thereon in engagement with the worm gear; a manually operable control movable in one direction for imparting axial movement to said shaft effective to cause the worm gear to move the gear segment and member, and movable in another direction for imparting rotational movement to the shaft effective to cause the worm gear to move the said gear segment and member; and linkage means operably connected to said member and positionable thereby for conditioning the operation of feed regulating mechanism for reverse feed in response to axial movement of the shaft, and for controlling the operation of the feed regulating mechanism in forward feed in response to rotational movement of the shaft.

2. The combination of claim 1 including locking means engageable by rotation of the shaft in a predetermined axial position for holding the shaft therein against axial movement to define a sustaining reverse feed controlling position for the linkage means.

3. The combination of claim 2 wherein the locking means includes a pin on the shaft and fixed structure in the machine with a shoulder to engage the pin.

4. The combination of claim 1 including a quick feed reversing lever operably connected with the pivotally mounted member for moving said member to position the linkage means in a reverse feed controlling position.

5. The combinatin of claim 4 wherein the quick feed reversing lever is remotely located in the machine relative to the said manually operable control, and the operable connection between the lever and said pivotally mounted member includes a pivotable shaft and a member which extends therefrom to engage the worm gear.

6. The combination of claim 5 wherein the member extending from the pivotable shaft to engage the worm gear has a forked end which embraces the rotatably and axially movable shaft under the worm gear.

7. The combination of claim 1 including spring means which biases the linkage means in a forward feed controlling position.

8. The combination of claim 7 which includes a fixed support for the rotatable and axially movable shaft and wherein the biasing spring means is located about such shaft between the fixed support and the worm gear.

* * * * *